US006142039A

United States Patent [19]

Herring, Sr.

[11] Patent Number: 6,142,039

[45] Date of Patent: Nov. 7, 2000

[54] BOTTLE CAP REMOVER

[76] Inventor: Ralph E. Herring, Sr., 33927 Fox Dr. NE., Albany, Oreg. 97321

[21] Appl. No.: 09/374,086

[22] Filed: Aug. 12, 1999

[51] Int. Cl.[7] ..... B67B 7/00

[52] U.S. Cl. ..... 81/3.2; 81/3.44; 81/3.42; 53/381.4; 53/492

[58] Field of Search ..... 81/3.2, 3.44, 3.42; 53/381.4, 492, 109

[56] References Cited

U.S. PATENT DOCUMENTS

| | | | |
|---|---|---|---|
| 3,914,920 | 10/1975 | Dilanni | 53/381 A |
| 4,265,071 | 5/1981 | Smith et al. | 53/492 |
| 5,255,574 | 10/1993 | Wuerschum | 81/3.2 |
| 5,778,740 | 7/1998 | Tye . | |
| 5,826,409 | 10/1998 | Slepicka et al. . | |

*Primary Examiner*—James G. Smith
*Assistant Examiner*—Hadi Shakeri
*Attorney, Agent, or Firm*—Miller Nash LLP

[57] ABSTRACT

A bottle cap remover having a gripping head and an actuator. The gripping head has at least two pivotally mounted arms biased in a closed position, each arm having a respective gripping surface. Preferably the bottle cap remover has a neutral state, an insertion state, a bottle-gripping state, and a cap-removal state. The method for removing a bottle cap from a bottle using the bottle cap remover includes the first step of inserting a bottle and bottle cap between the gripping surfaces of the pivotally mounted arms by forcing the pivotally mounted arms into an at least partially open position. The next step is gripping the bottle cap between the gripping surfaces. The next step is to activate the actuator so that the actuator moves between a neutral position and an extreme position thereby pulling and removing the bottle cap from the bottle.

9 Claims, 6 Drawing Sheets

BOTTLE CAP REMOVER

BACKGROUND OF THE INVENTION

The present invention is directed to a bottle cap remover for removing a bottle cap from a bottle.

The bottled water industry, which provides large bottles of water (typically five gallons, three gallons, or 19 liters) for use with drinking water dispensing systems or "water coolers," has been undergoing significant changes in recent years. For example, heavy, breakable glass bottles have been largely replaced by bottles made from lighter polycarbonate, plastic, or similar substantially unbreakable material. Recently, new bottle caps have begun replacing the standard, soft plastic, perforated caps that must be removed by the user before the bottle can be positioned on the water cooler for use. These new caps are designed to engage a mechanism of a specially designed water cooler so that the bottle can be used without removing the bottle cap. This significantly reduces spillage common when the bottle is inverted after removal of the standard cap.

When bottled water distributors deliver bottled water, they typically pick up the empty used containers, which are then "recycled" by being washed, refilled, and delivered again for consumer use. When the used containers with the standard caps are returned to the distributor, the caps have been removed by the user. When the used containers with the new caps are returned, however, the caps are still in place, and water distributors must therefore add the extra step of removing the new cap prior to recycling. When hundreds of new caps must be removed daily, significant man-hours are involved.

Various machines for automating the removal of bottle caps in the recycling process have been developed. For example, U.S. Pat. No. 5,826,409 to Slepicka et al. is directed to a bottle cap removing system that is easily adapted to a bottle-washing conveyor system. This complicated system determines whether a bottle is capped, stops the capped bottle's movement on the conveyor, lowers a decapping assembly over the bottle cap, engages the bottom edge of the bottle cap in a pair of removal jaws using a removal jaw piston, pulls the cap up and off the bottle, and discharges the cap through a side chute. There are several problems with the Slepicka et al. device. First, the system is complicated because it is designed to function with a standard conveyor system. Such added features as determining whether a bottle is capped, stopping the bottle's movement, and lowering the decapping assembly make the system expensive and add additional parts that are subject to breakage. Even the removal jaw piston is subject to breakage. Another problem with this system is that it is designed so that the rear jaw lip and the front jaw lip engage with the bottom edge of a bottle cap and therefore tend to come into contact with the bottle. The jaws may scratch the bottle, and the jaws may spread contaminants from one bottle to another as they touch successive bottles.

U.S. Pat. No. 5,788,740 to Tye is directed to a bottle cap remover that includes a gripping mechanism that is initially biased in an open position. When a bottle is inserted into the remover, the gripping mechanism is automatically moved toward the bottle while hook-shaped members are simultaneously forced into a closed position. This configuration attempts to solve some of the aforementioned problems associated with previous systems. For example, the bottle cap remover has been substantially simplified so that it is only semiautomatic and therefore less expensive to produce and less prone to breakdowns. The bottle cap remover, however, still includes a mechanism for automatically activating the bottle cap remover when the bottle is inserted into the appropriate orifice. Further, the gripping mechanism has been substantially simplified so that a separate actuator is not needed in order to close the hook-shaped members around the bottle cap. Exterior cam members, however, are needed to force the hook-shaped members together. Another improvement is that the hook-shaped members engage the bottle cap without touching the bottle. One problem with the Tye bottle cap remover is that there is no way to verify that the bottle is correctly positioned when the open gripping head begins to move toward the bottle, when the bottle cap is gripped in the hook-shaped members, and when the bottle cap is removed from the bottle. If the bottle is not in the correct position initially or is moved after the bottle cap remover has been activated, the hook-shaped members will probably damage the bottle. Also, the automatic nature of the Tye system could be dangerous if a small child put his arm into the bottle cap remover opening into which the bottle is inserted.

BRIEF SUMMARY OF THE INVENTION

The present bottle cap remover solves the aforementioned problems by providing a simple bottle cap remover that is relatively inexpensive to produce, is not prone to breakage, protects the bottle from damage, and is safe to use.

The bottle cap remover of the present invention includes a gripping head and an actuator. The gripping head preferably includes at least two pivotally mounted arms biased in a closed position, each arm having a respective gripping surface. When a bottle and bottle cap are inserted into the gripping head and the actuator, which is operatively attached to the gripping head, moves between a neutral position and an extreme position, the bottle cap is pulled from the bottle. Preferably the bottle cap remover has a neutral state, an insertion state, a bottle-gripping state, and a cap-removal state.

The present invention also includes a method for removing a bottle cap from a bottle using the bottle cap remover described above. Specifically the first step is to insert a bottle and bottle cap between the gripping surfaces of the pivotally mounted arms by forcing the pivotally mounted arms into an at least partially open position. The next step is to grip the bottle cap between the gripping surfaces. The next step is to activate the actuator so that the actuator moves between a neutral position and an extreme position thereby pulling and removing the bottle cap from the bottle. There may be an additional step of releasing the bottle cap from the gripping head.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
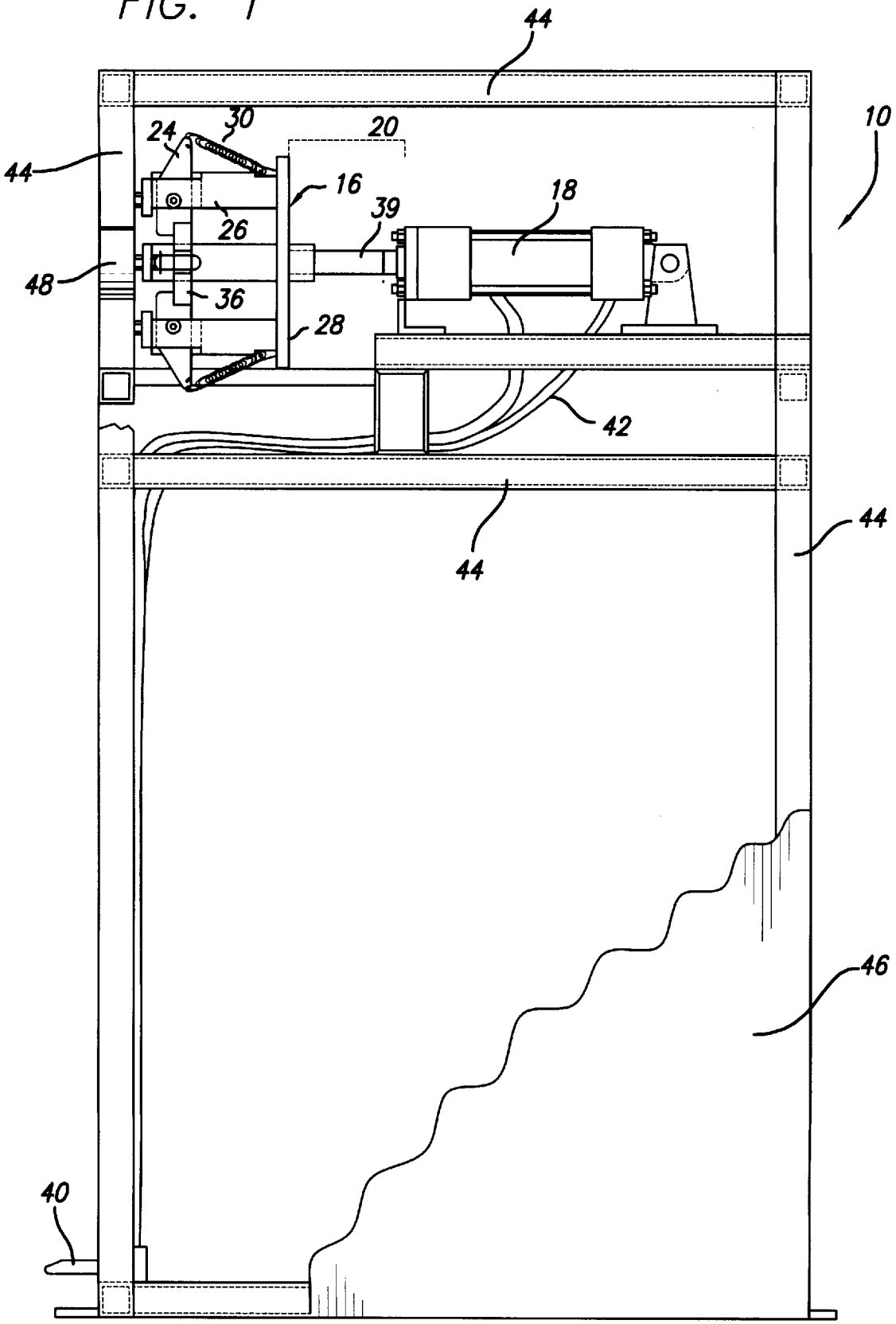
FIG. 1 is a side elevational view of the bottle cap remover of the present invention in the neutral state.
Figure 2:
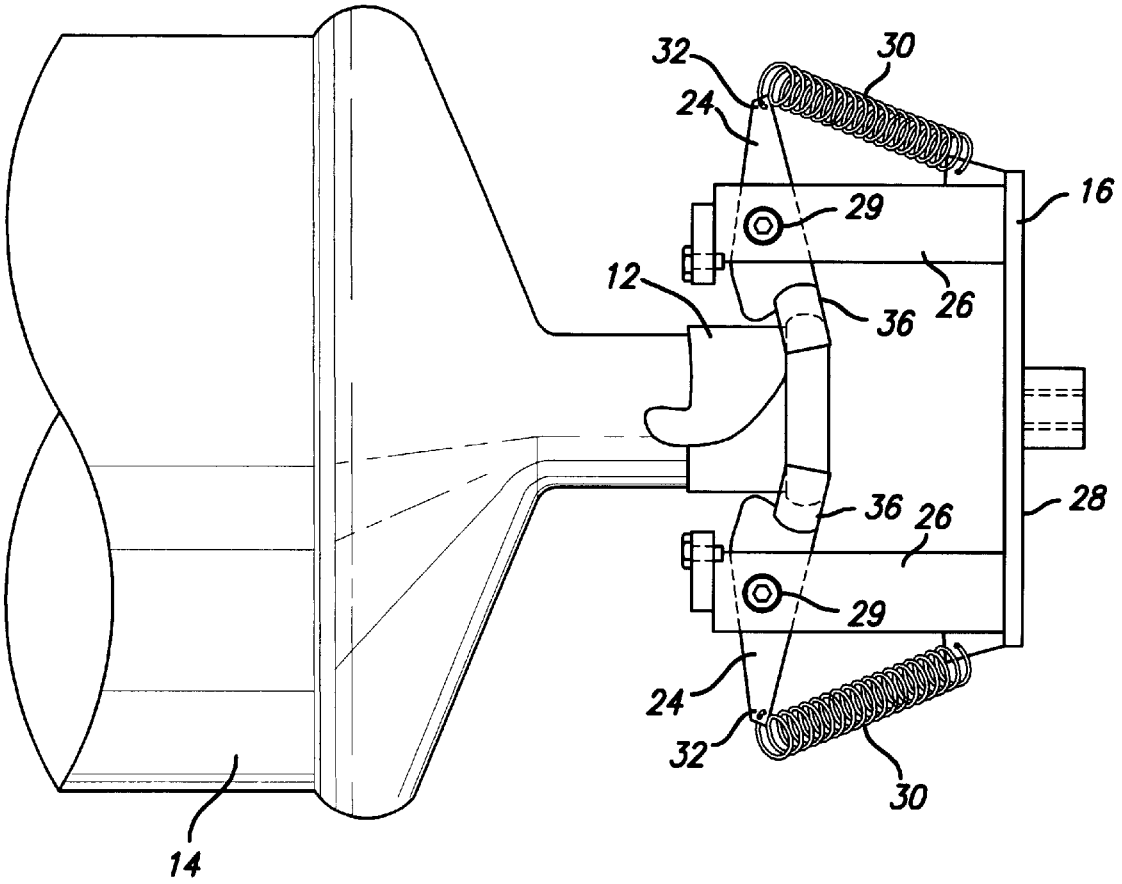
FIG. 2 is an enlarged side view of the gripping head of the present invention as a bottle and bottle cap are being inserted thereto.

FIG. 1 shows a bottle cap remover 10 of the present invention that may be used to remove a bottle cap 12 from a bottle 14. In the shown preferred embodiment, the bottle cap remover 10 includes a gripping head 16 into which the bottle 14 and bottle cap 12 may be inserted as shown in FIG. 2. Once the bottle 14 and bottle cap 12 are gripped or held securely within the gripping head 16 (FIG. 3), an actuator 18 is activated that moves the gripping head 16 from a neutral position 20 (FIGS. 1 and 3) to an extreme position 22 (FIG. 4) distant from the bottle 14. In moving from the neutral position 20 to the extreme position 22 the bottle cap 12, which is held securely by the gripping head 16, is pulled off the bottle 14.

The gripping head 16 of the present invention includes at least two pivotally mounted arms 24. Each shown pivotally mounted arm 24 is pivotally connected to a respective projection 26 mounted on a common cross-member 28. Each of the arms 24 is individually biased in a closed position. The pivoting is accomplished using a pivot 29 such as a bolt or screw. The biasing is accomplished using a biasing mechanism 30, such as a spring or piston, at an outer end 32 of the respective arm 24. As shown in FIG. 2, when a bottle 14 and bottle cap 12 are inserted into the gripping head 16, the arms 24 pivot against the biasing mechanisms 24, forcing the gripping head 16 into an at least partially open position.

Figure 5:
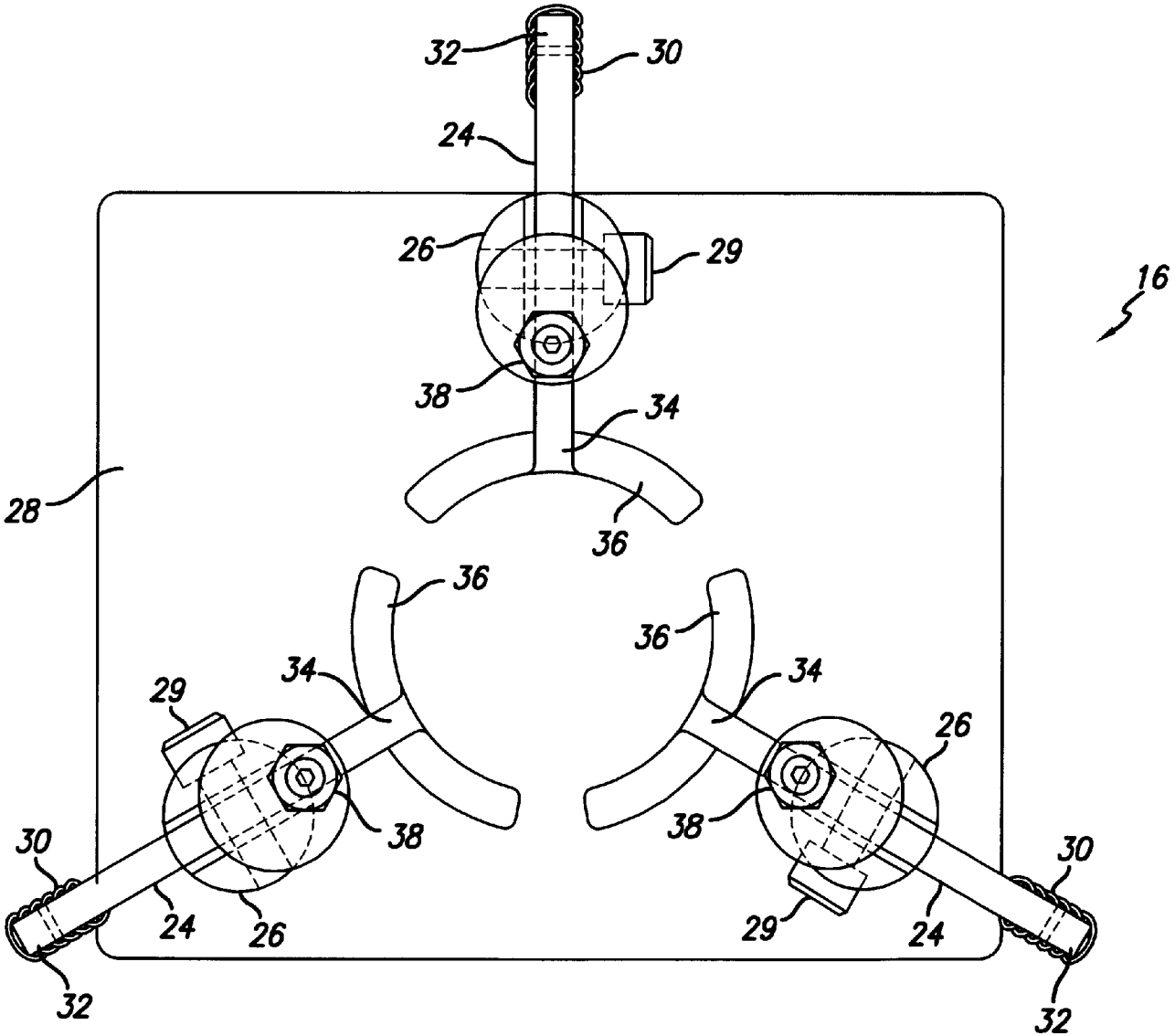
FIG. 5 is an enlarged plan view of the gripping head in the neutral state.

At the inner end 34 of each pivotally mounted arm 24 there is an associated gripping surface 36 for gripping the bottle cap 12. As shown in FIG. 5, one preferred embodiment of the present invention includes three gripping surfaces 36 that together substantially form a circular inner diameter. One or more adjustment mechanisms 38 may be included to allow adjustment of the level of the gripping surfaces 36 in the closed position or the size of the circular inner diameter.

The gripping head 16, as described above, is passive, in that it does not require outside mechanisms like pistons or cam members to open or close the gripping surfaces 36. It is also extremely practical in that it is not prone to breakage and is simple to repair if a part does break. Further, the simplicity makes the gripping head 16 relatively easy to manufacture and reduces the costs of manufacturing.

Figure 3:
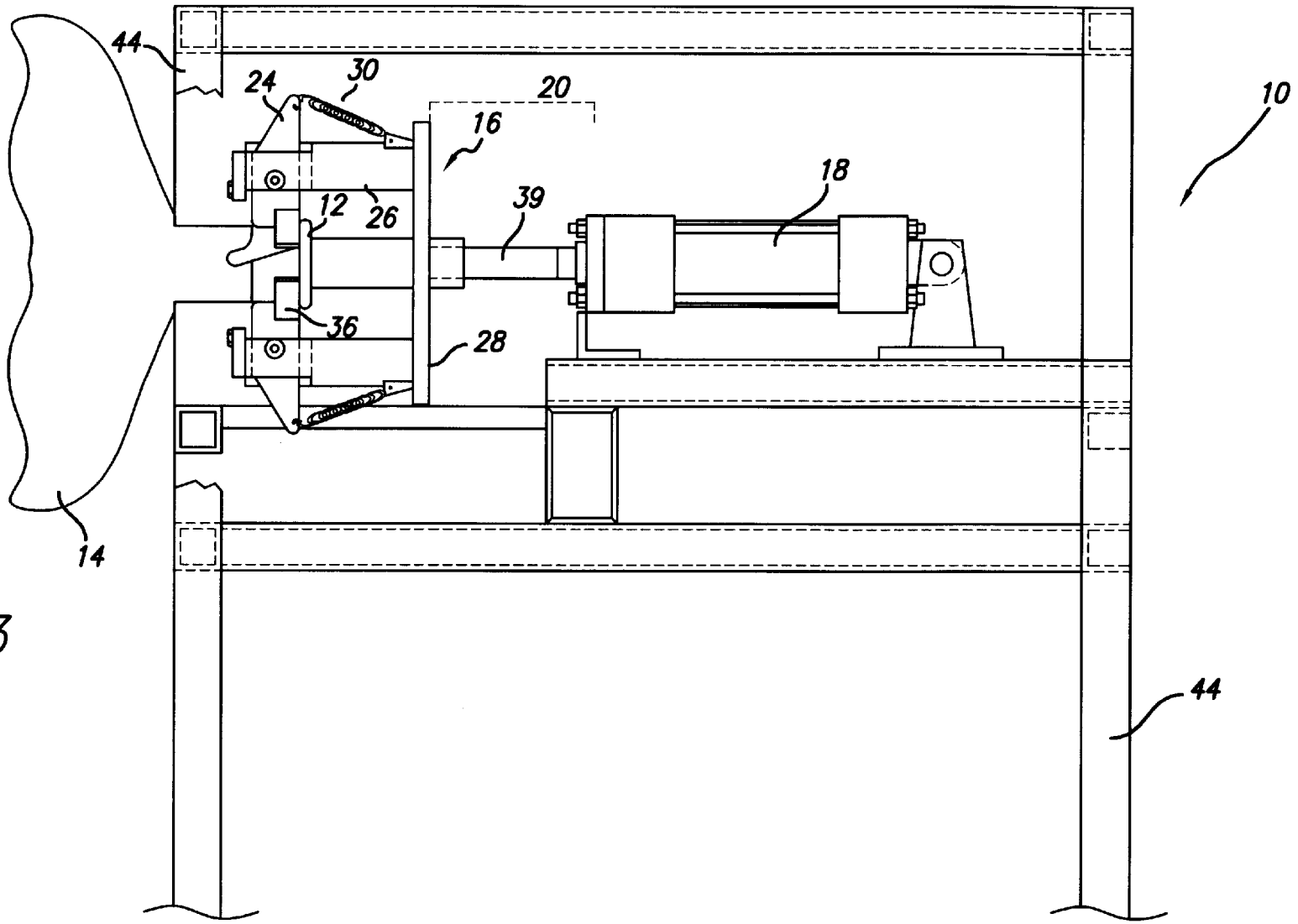
FIG. 3 is a partial side elevational view of the bottle cap remover of the present invention in the bottle-gripping state.
Figure 4:
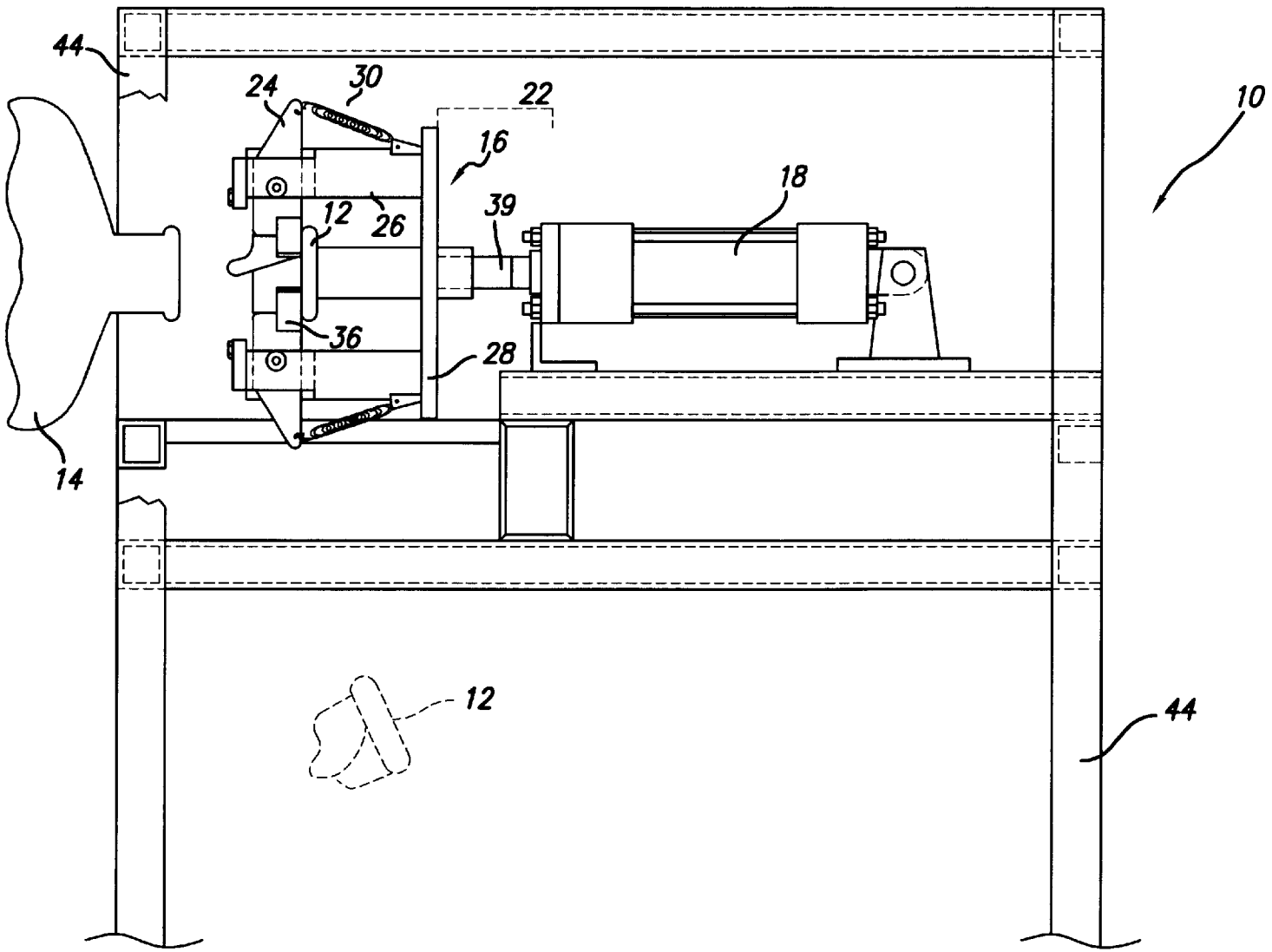
FIG. 4 is a partial side elevational view of the bottle cap remover of the present invention in the cap-removal state.

An actuator 18 such as a hydraulic cylinder, pneumatic cylinder, or piston is operatively attached to the gripping head 16. In the shown preferred embodiment, the actuator 18 includes an extension 39 that moves into and out of the actuator 18 when the actuator 18 is activated. The extension 39 is attached to the gripping head 16, and as the extension 39 moves into the actuator 18, the gripping head 16 moves from a neutral position 20 (FIGS. 1 and 3) to an extreme position 22 (FIG. 4). The actuator 18 then recycles the gripping head 16 back to the neutral position as the extension 39 moves out of the actuator 18. The actuator 18 may be a cylinder such as that produced by Schrader Bellows Cylinders of Des Plains, Ill.

Preferably the actuator 18 is activated by a remote activation switch 40 such as that shown in FIG. 1. In the shown embodiment, the switch 40 is physically connected to the actuator 18 by connectors 42. Alternatively, the switch 40 could be connected to the actuator by a solenoid or other signal-transmitting device. There are several advantages to remote, nonautomatic activation that are not present in more automatic systems. For example, there is an opportunity to verify that the bottle 14 is in the correct position so that it will not be damaged. Another advantage is that an accidentally inserted hand or other apparatus will not mistakenly activate the bottle cap remover 10. Finally, elimination of the sensors and other devices needed for more automatic systems reduces the cost and complication associated with more automatic systems.

Figure 6:
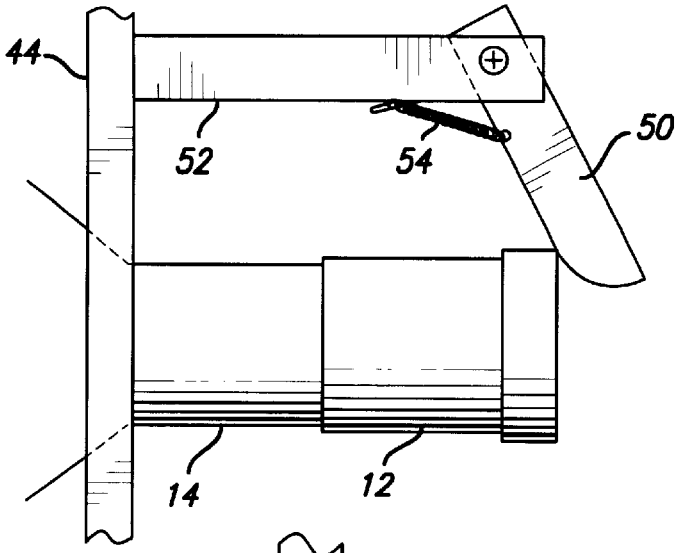
FIG. 6 is an enlarged view of an exemplary gripping head clearer lever in the insertion state and the bottle-gripping state.
Figure 7:
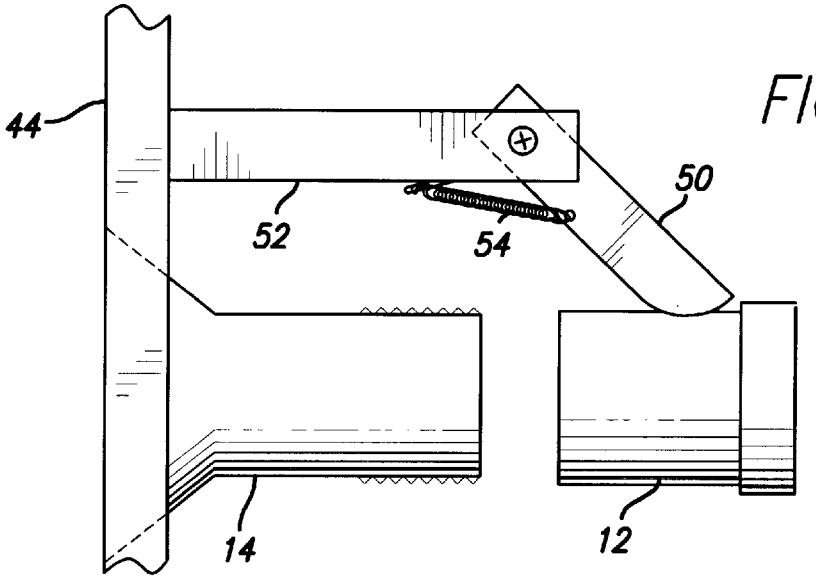
FIG. 7 is an enlarged view of an exemplary gripping head clearer lever in the cap-removal state.
Figure 8:
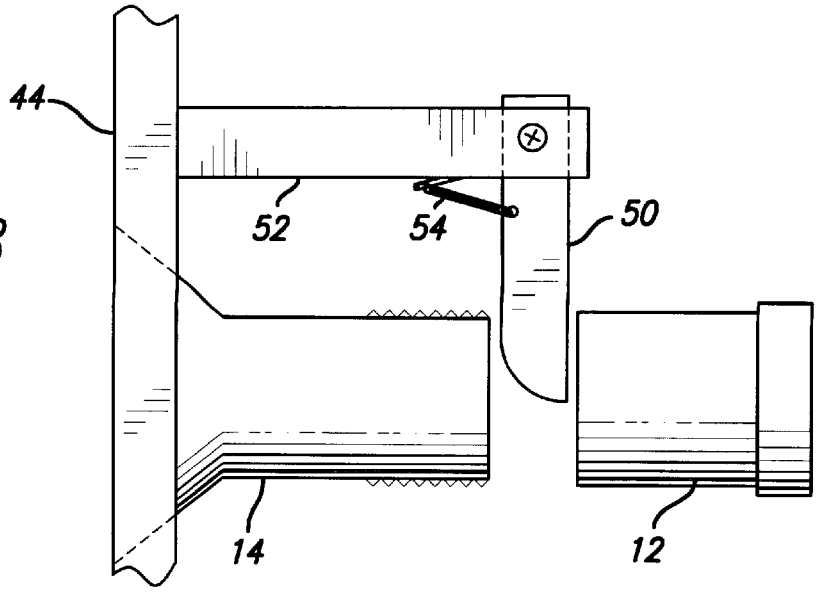
FIG. 8 is an enlarged view of an exemplary gripping head clearer lever in the neutral state.

Although the bottle cap 12 may simply fall or be jarred from the gripping head 16 after the cap 12 has been removed from the bottle 14, FIGS. 6–8 show an exemplary gripping head clearer lever 50 that may be used to clear the gripping head 16 of removed caps 12. As shown in FIGS. 6–8, the gripping head clearer lever 50 may be pivotally mounted on an inward projection 52 that extends inward from the front of the bottle cap remover 10. The tip of the gripping head clearer lever 50 would be positioned so that it would contact a bottle cap 12 between two gripping surfaces 36 without interfering therewith. Although the gripping head clearer lever 50 may pivot to allow a bottle cap 12 to pass thereby, a spring 54 may be used to bias the gripping head clearer lever 50 in a neutral position (FIG. 8) when not forced forward by a bottle cap 12. When the bottle cap 12 is inserted into the bottle cap remover 10, the gripping head clearer lever 50 is preferably forced to swing at least partially upwards. As the bottle cap remover 10 is activated and the gripping head 16 moves towards the actuator (the cap-removal state), the gripping had clearer lever 50 is pulled further forward (FIG. 7) and the bottle cap 12 is removed from the bottle. The spring 54 forces the gripping head clearer lever 50 to a neutral position (FIG. 8) behind the removed cap 12. Then, as the gripping head 16 returns to its original position, the backside of the cap 12 encounters the gripping head clearer lever 50 and the cap 12 is forced from the gripping head 16.

To remove a bottle cap 12 from a bottle 14 using a bottle cap remover 10, the mouth of a bottle 14 and an attached bottle cap 12 are inserted between the gripping surfaces 36 of the pivotally mounted arms 24 by forcing the pivotally mounted arms 24 into an at least partially open position as shown in FIG. 2. Once inserted as shown in FIG. 3, the bottle cap 12 is gripped between the gripping surfaces 36 with the pivotally mounted arms 24 substantially in the closed position. With the bottle 14 correctly positioned, and a clear path available for the actuator 18, the actuator 18 is activated so that it moves from the neutral position 20 to the extreme position 22 and in the process pulls and removes the bottle cap 12 from the bottle 14. The removed bottle cap 12, as shown in FIG. 4, is removed from the gripping head 16 and falls into a bag, basket, or other collector waiting below to catch the removed cap 12. Simultaneously, the actuator 18 recycles the gripping head 16 back to the neutral position 20 so that the bottle cap remover 10 is ready to accept another capped bottle.

It should be noted that the bottle cap remover 10 can be said to have four primary states: a neutral state (FIG. 1), an insertion state (FIG. 2), a bottle-gripping state (FIG. 3), and a cap-removal state (FIG. 4). In the neutral state, the gripping head 16 is in the closed position, and the actuator 18 is in the neutral position 20. In the insertion state, the gripping head 16 is forced into an at least partially open position while the actuator 18 remains in the neutral position 20. In the bottle-gripping state, the gripping head 16 returns to a substantially closed position with the gripping surfaces gripping the bottle cap 12, and the actuator 18 remains in the neutral position 20. In the cap-removal state, the gripping head 16 remains in the substantially closed position with the gripping surfaces gripping the bottle cap 12, and the actuator 18 moves between the neutral position 20 and the extreme position 22, thereby pulling the cap 12 from the bottle 14.

As shown in FIG. 1, the bottle cap remover 10 may be mounted on a frame 44. The frame 44 may then be enclosed within a housing 46. A housing bottle opening 48 would be provided that is suitable for receiving the inserted bottle cap 12 and the mouth of the bottle 14. The housing bottle opening 48 is also small enough to exclude the shoulder of the bottle 14. This configuration is particularly advantageous because it prevents the bottle 14 from being pulled forward as the actuator 18 moves the gripping head 16 from the neutral position 20 to the extreme position 22.

Additional aspects of this invention include the use of high-quality, anodized materials in its construction. Further, the actuator 18 may have bumpers on both ends to increase the life of the actuator 18.

The terms and expressions employed in the foregoing specification are used as terms of description and not of limitation, and there is no intention in the use of those terms and expressions of excluding equivalents of the features shown and described or portions thereof, it being recognized that the scope of the invention is defined and limited only by the claims that follow.

What is claimed is:

1. A bottle cap remover for removing a bottle cap from a bottle, said cap remover comprising:

a) a gripping head having at least two pivotally mounted arms, each of said at least two pivotally mounted arms being individually biased in a closed position;

b) a gripping surface associated with each of said at least two pivotally mounted arms, each gripping surface for gripping said bottle cap; and c) an actuator operatively attached to said gripping head, said actuator movable between a neutral position and an extreme position, said actuator moving to said extreme position upon activation of said actuator;

d) wherein said bottle and bottle cap are inserted between said gripping surfaces while said actuator is in said neutral position.

2. The bottle cap remover of claim 1 wherein said at least two pivotally mounted arms being pivotally connected to respective projections, said projections mounted on a common cross-member.

3. The bottle cap remover of claim 1, said at least two pivotally mounted arms being individually biased in a closed position using a biasing mechanism.

4. The bottle cap remover of claim 3 wherein said biasing mechanism is a spring.

5. The bottle cap remover of claim 1 wherein said gripping surfaces of each of said at least two pivotally mounted arms together define a circular inner diameter.

6. A method for removing a bottle cap from a bottle, said method comprising the steps of:

a) providing a bottle cap remover having a gripping head with at least two pivotally mounted arms with gripping surfaces, said pivotally mounted arms being biased in a closed position;

b) inserting a bottle and bottle cap between gripping surfaces of said at least two pivotally mounted arms by forcing said pivotally mounted arms into an at least partially open position;

c) gripping said bottle cap between said gripping surfaces with said pivotally mounted arms substantially in said closed position; and d) activating an actuator operatively attached to said gripping head so as to move said actuator between a neutral position and an extreme position thereby pulling and removing said bottle cap from said bottle.

7. The method of claim 6 further comprising the step of releasing said bottle cap from said gripping head.

8. The method of claim 6 further comprising the step of recycling said actuator to receive another bottle.

9. A bottle cap remover for removing a bottle cap from a bottle, said cap remover comprising:

a) a gripping head having at least two pivotally mounted arms with gripping surfaces for gripping said bottle cap, said pivotally mounted arms being biased in a closed position;

b) an actuator operatively attached to said gripping head, said actuator movable between a neutral position and an extreme position; and c) said bottle cap remover having a neutral state, an insertion state, a bottle-gripping state, and a cap-removal state:

i) said gripping head being in said closed position and said actuator being in said neutral position when said bottle cap remover is in said neutral state;

ii) said gripping head being forced into an at least partially open position and said actuator being in said neutral position when said bottle cap remover is in said insertion state;

iii) said gripping head being substantially in said closed position with said gripping surfaces gripping said bottle cap and said actuator being in said neutral position when said bottle cap remover is in said bottle-gripping state; and iv) said gripping head being substantially in said closed position with said gripping surfaces gripping said bottle cap and said actuator moving between said neutral position and said extreme position when said bottle cap remover is in said cap-removal state.

* * * * *